US006578565B2

(12) United States Patent
Casas Salva

(10) Patent No.: US 6,578,565 B2
(45) Date of Patent: Jun. 17, 2003

(54) AIR OR GAS-POWERED GUNS

(75) Inventor: Francisco Casas Salva, Barcelona (ES)

(73) Assignee: Industrias El Gemo, SA, Barcelona (ES)

( * ) Notice: Subject to any disclaimer, the term of this patent is extended or adjusted under 35 U.S.C. 154(b) by 0 days.

(21) Appl. No.: 09/899,040

(22) Filed: Jul. 6, 2001

(65) Prior Publication Data

US 2002/0092514 A1 Jul. 18, 2002

(30) Foreign Application Priority Data

Jul. 6, 2000 (ES) ..... 200001679

(51) Int. Cl.[7] ..... F41B 11/02; F41B 11/32

(52) U.S. Cl. ..... 124/73; 124/71; 124/40; 124/48

(58) Field of Search ..... 124/71, 72, 73, 124/74, 31, 40, 48, 56

(56) References Cited

U.S. PATENT DOCUMENTS 3,233,601 A * 2/1966 Walther ..... 124/40
3,612,026 A * 10/1971 Vadas et al. ..... 124/31
5,160,795 A 11/1992 Milliman ..... 42/65
5,165,383 A * 11/1992 Ebert et al. ..... 124/40
5,285,766 A * 2/1994 Milliman ..... 124/48
5,400,536 A * 3/1995 Milliman ..... 124/74
5,404,863 A * 4/1995 Poor ..... 124/56
5,704,150 A * 1/1998 Milliman ..... 42/63
5,884,615 A * 3/1999 Casas Salva ..... 124/31
5,906,191 A * 5/1999 Wonisch et al. ..... 124/31

* cited by examiner

*Primary Examiner*—Charles T. Jordan
*Assistant Examiner*—John W. Zerr
(74) *Attorney, Agent, or Firm*—Jacobson Holman PLLC

(57) ABSTRACT

A frame bearing a compressed air/gas reservoir connected to an assembly of a valve operated by a hammer striking the valve slide, a trigger operating the hammer, a tilting assembly on the frame including a barrel and a detachable, rotating, cylindric loading clip with a plurality of recesses for a projectile. A device for step by step rotating the loading clip is mounted on the frame including a first set of levers connected to each other, one of them being linked to the trigger and another linked to the loading clip when the tilting assembly is in the firing position.

8 Claims, 6 Drawing Sheets

AIR OR GAS-POWERED GUNS

FIELD OF THE INVENTION

This invention refers to an air or gas-powered gun, of the kind comprising a pivoting barrel which in firing position is aligned with the outlet of a delivery valve connected to a compressed air or gas reservoir, a hammer for operating the delivery valve actuated by a trigger, a detachable cylindric loading clip, interposed between the valve outlet and the barrel, provided with several recesses for holding projectiles, and means associated to the trigger in order to step by step rotate the loading clip to align each of the recesses with the barrel at the moment of firing.

BACKGROUND OF THE INVENTION

U.S. Pat. No. 5160795 discloses a gun of this kind in which the barrel and the detachable cylindric loading clip are arranged on a tilting assembly hinged with respect to a frame. The tilting assembly in addition includes a set of levers constituting the means for step by step rotating the loading clip. The tilting assembly is provided with a movement between an open loading position, in which the loading clip is accessible and a closed firing position in which the barrel is aligned with a recess of the loading clip and with the outlet of the air or gas delivery valve, and in which a lever of the set of levers of the step by step rotating means is coupled with a part of the trigger.

The hammer is pivotingly mounted between a cocked position and a firing position, and it is elastically loaded for striking a slide of the delivery valve, this later leaving thus that an amount of compressed air or gas is allowed to pass which is sufficient for impelling a projectile from the loading clip through the barrel. The hammer is cocked by the trigger, which has associated a link comprising a groove which is coupled to a protruding roller mounted on the hammer bottom. When the trigger is pressed, the link is moved backwards and rotates the hammer against the elastic strength, hammering it. The hammer includes a cam which, when exceeding a given hammering angle, lifts the link, releasing the elastic strength accumulated in the hammer so that this later wildly rotates towards the valve slide for firing.

Mounted hinged on the link, there is a safety part which prevents that the hammer strikes the valve slide if the trigger has not been previously operated. That part, when the trigger is pressed and the link is moving backwards, is lifted to be interposed between the hammer head and the valve slide transmitting the hammer striking power to the valve. When the trigger is not pressed, the safety part is not interposed and the hammer head does not achieve its slide striking.

A drawback shown by the gun consists in the fact that the loading clip step by step rotating mechanism is mounted on the tilting assembly, as it adds complexity to the assembly and increases the likelihood that, unwanted misalignments occur. To prevent them, the gun disclosed requires providing the trigger with a linear travel and including an appendage integral with the trigger designed to secure the correct alignment of related projectile holding recess with the barrel at the moment of firing when the appendage is inserted in grooves located on the cylindric wall of the loading clip.

On the other hand, the gun disclosed lack a safety which prevents that the trigger is operated when the tilting assembly is in an open loading position therefore a useless expense of compressed air or gas and the mechanisms idle operation would be prevented.

To overcome above drawbacks, an object of this invention is to provide a gun of this kind in which the step by step rotating mechanism of the loading clip is mounted on the frame thereof.

Another object of this invention is to provide a gun of this kind which has a safety device preventing to actuate the trigger when the tilting assembly is in open loading position.

Eventually, another object of this invention is to provide a gun of this kind in which a safety device for preventing a casual shot without the trigger having been actuated comprises a mechanism independent from the mechanism of the hammer being cocked by the trigger.

SUMMARY OF THE INVENTION

Above purposes are achieved, according to this invention, by providing an air or gas powered gun comprising a frame supporting a compressed air or gas reservoir connected to an assembly of delivery valve operated by a hammer striking a slide of the valve. On the frame there is mounted a trigger provided with a pivoting movement between a resting position and a firing position, the trigger can actuate the hammer. Mounted hinged on the frame there is a tilting assembly provided with a movement between an open loading position and a closed firing position, the tilting assembly comprising a barrel and a detachable cylindric loading clip rotatably mounted with respect to an axis parallel to the longitudinal axis of the barrel, the loading clip being provided with a plurality of recesses holding a projectile.

Mounted on one part of the frame, with respect to which the tilting assembly bearing the barrel and the loading clip is hinged, there is provided means of step by step rotation of the loading clip associated to the movement of the trigger to step by step rotate the loading clip for aligning one of the recesses holding a projectile with the barrel at the moment of firing. The step by step rotating means comprise a first set of levers functionally connected to each other, one of the levers being linked to the trigger and another of the levers being linked to the loading clip when the tilting assembly is at its said firing position.

The gun of this invention includes means constituting a locking safety for locking the movement of the trigger by immobilizing a member of the first set of levers when the tilting assembly is at referred open loading position in which there exists an access to the loading clip. The locking means are released by the action of the tilting assembly when the tilting assembly is located at its closed firing position, in which the barrel and a related recess holding a projectile of the loading clip are aligned with the outlet of the assembly of air compressed delivery valve.

The gun of this invention in addition comprises safety means for preventing the hammer strikes the slide of the valve without the trigger has been operated, the safety means comprising a safety part functionally connected to the trigger through a second set of levers, the safety part remaining in a position interposed between the valve slide and the hammer, transmitting the strength of the impact thereof, when the trigger is in its firing position, and the safety part is withdrawn from the intermediate position when the trigger is in its resting position, so that an eventual impact of the hammer does not reach the valve slide. These safety means allow the hammer direct cocking independently from the trigger, and are useful for preventing a fortuitous shot when the hammer, being cocked, is accidentally released, for example when it is hurt because of a fall, so that the safety means are usually called "fall safety".

BRIEF DESCRIPTION OF THE DRAWINGS

These and other characteristics shall be best understood from the following detailed description of a preferred example of embodiment, which is provided for mere illustrative and not limitative purpose, with reference to the drawings appended, in which.

DETAILED DESCRIPTION OF AN EXAMPLE OF PREFERRED EMBODIMENT

Figure 1:
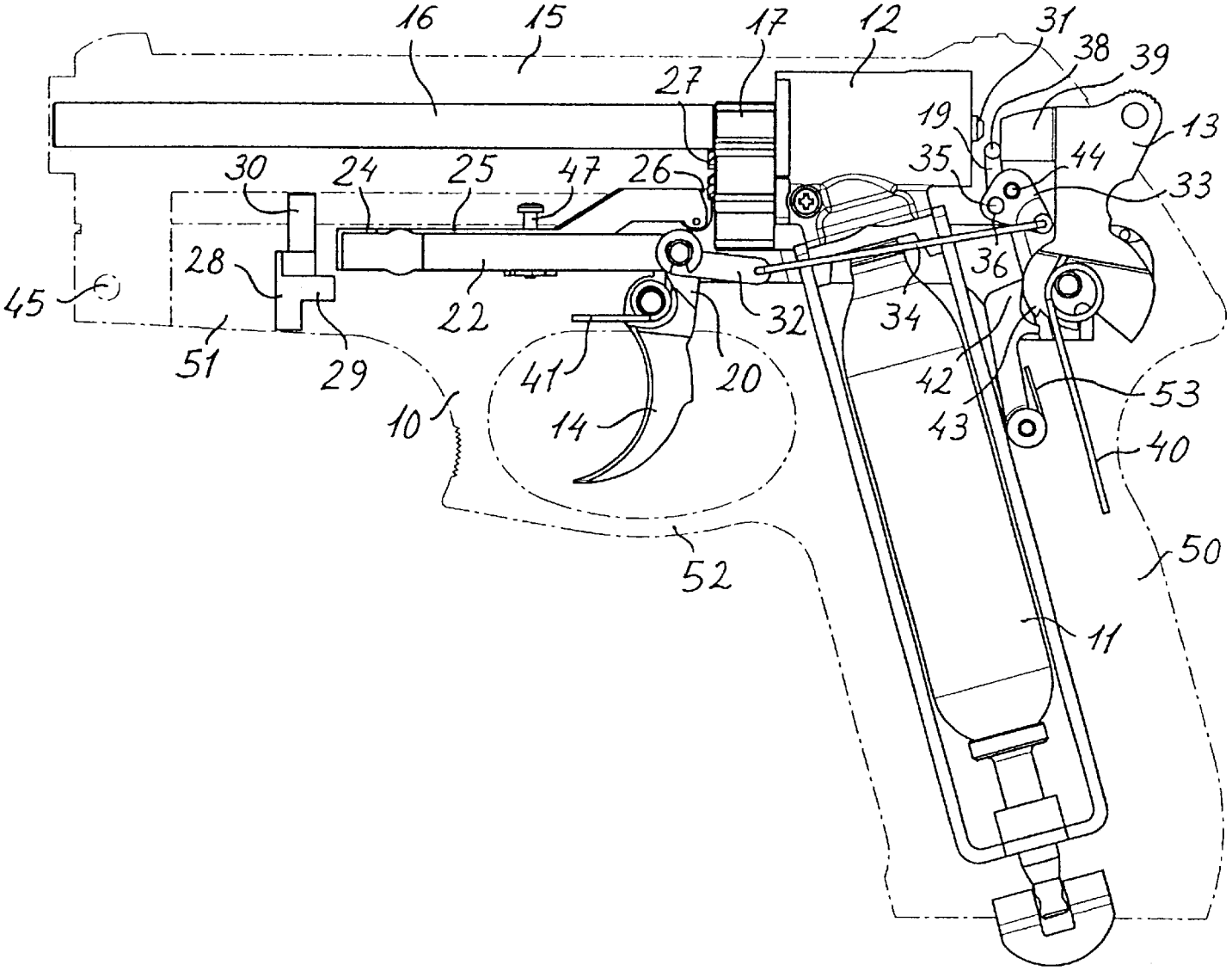
FIG. 1 is a side elevation view of an air or gas-powered gun according to this invention from which have been eliminated or are indicated by means of a broken line outline, several structural elements in order to only show the different mechanisms related to the invention, which are at a resting position.

Referring to FIG. 1, the gun of this invention comprises a frame 10 comprising a part of handle 50, a part of barrel 51 and a housing for the trigger 52. At the handle part 50 of the frame 10 there is mounted an air or other compressed gas reservoir 11 connected to an assembly of delivery valve 12 for the air or gas actuated by a hammer 13 striking the valve slide 31 which protrudes from the rear end of the valve assembly 12. The operation of this valve assembly 12 is conventional, therefore its explication-will be omitted from this specification. The hammer 13 is tiltingly mounted on the frame 10 and is provided with a movement between a cocked position, shown in FIG. 2 and a resting or firing position, shown in FIG. 1 and is elastically loaded by a spring 40. A retaining catch 42 loaded by a spring 53 can be locked in a groove 43 of the bottom of the hammer 13 for holding it in the cocked position.

Figure 2:
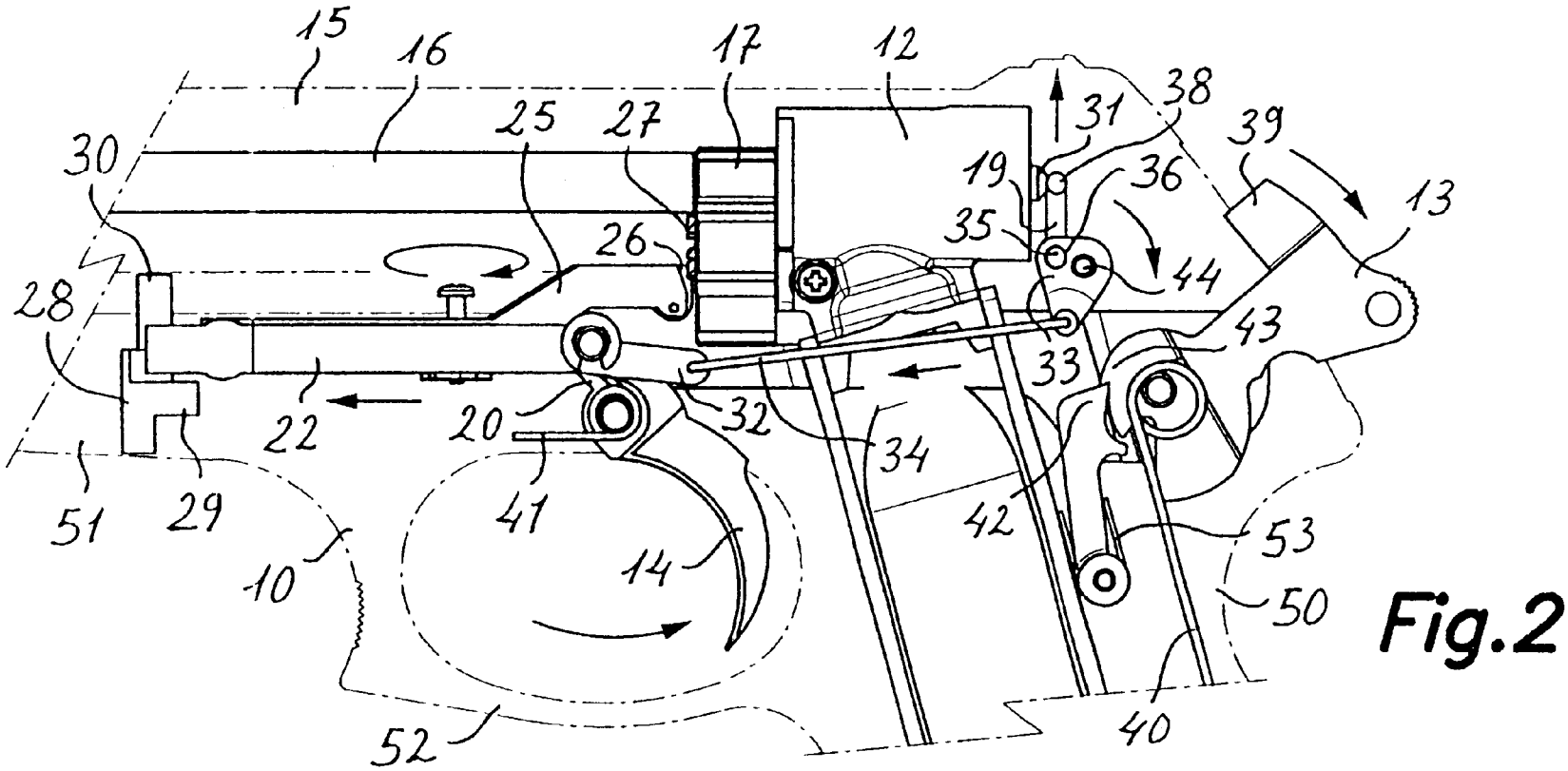
FIG. 2 is a part side elevation view of the gun of FIG. 1 with the mechanisms in a position immediately prior to the firing position.

In the housing of the trigger 52 of the frame 10 a trigger 14 is rotatably mounted, elastically loaded by a spring 41 and provided with a movement between a resting position, shown in FIG. 1 and a firing position, shown in FIG. 2, the trigger 14 actuates the hammer 13 through a mechanism, not shown, located at the opposite side of the one shown in the figures and releases the previously cocked hammer 13 displacing the retaining catch 42.

Figure 4:
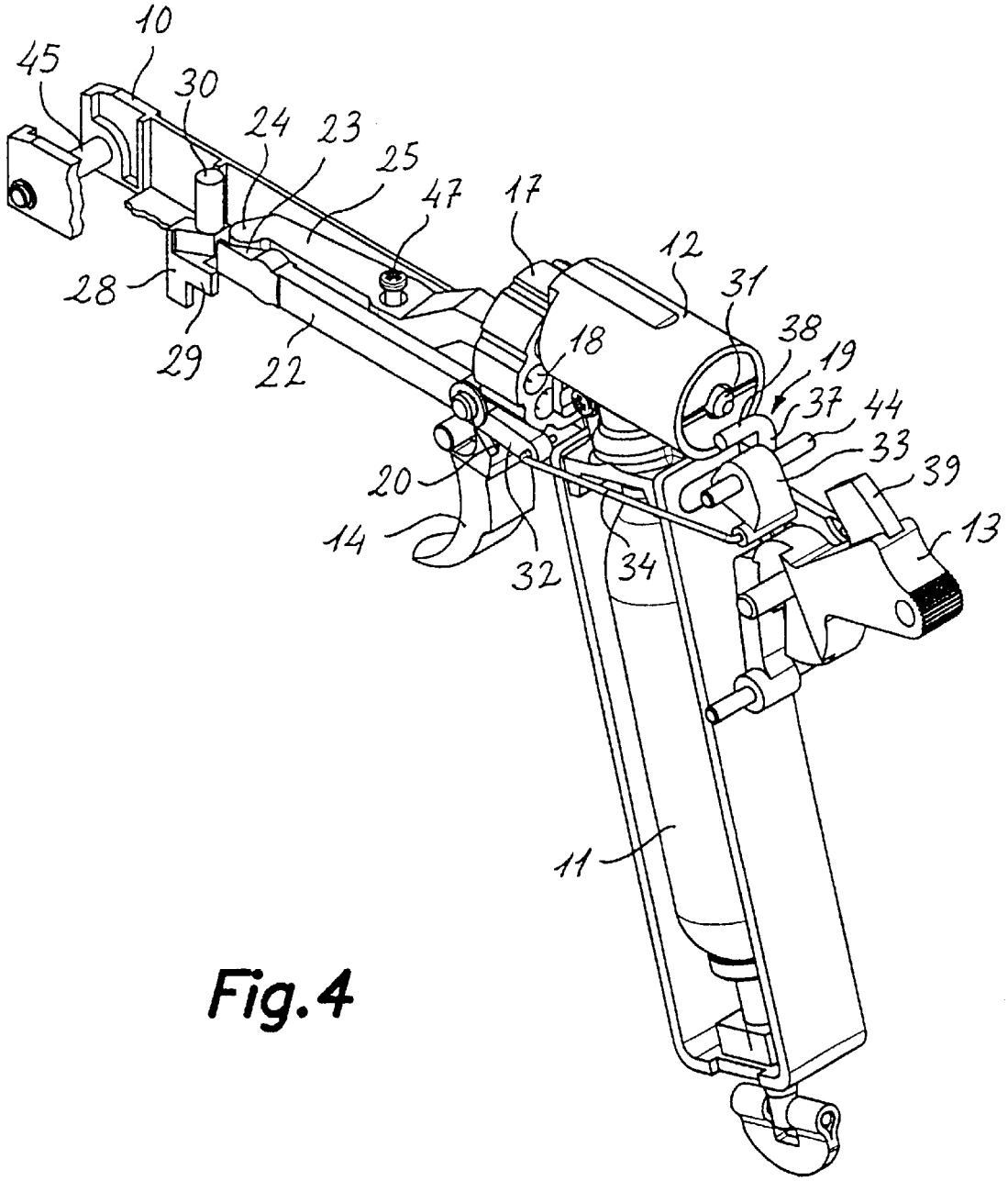
FIG. 4 is a three quarters rear top view in perspective of the gun of FIG. 1 from which some parts have been withdrawn or partly sectioned for best showing the step by step rotating mechanisms, locking safety device of the trigger at the open loading position and fall safety device.
Figure 5:
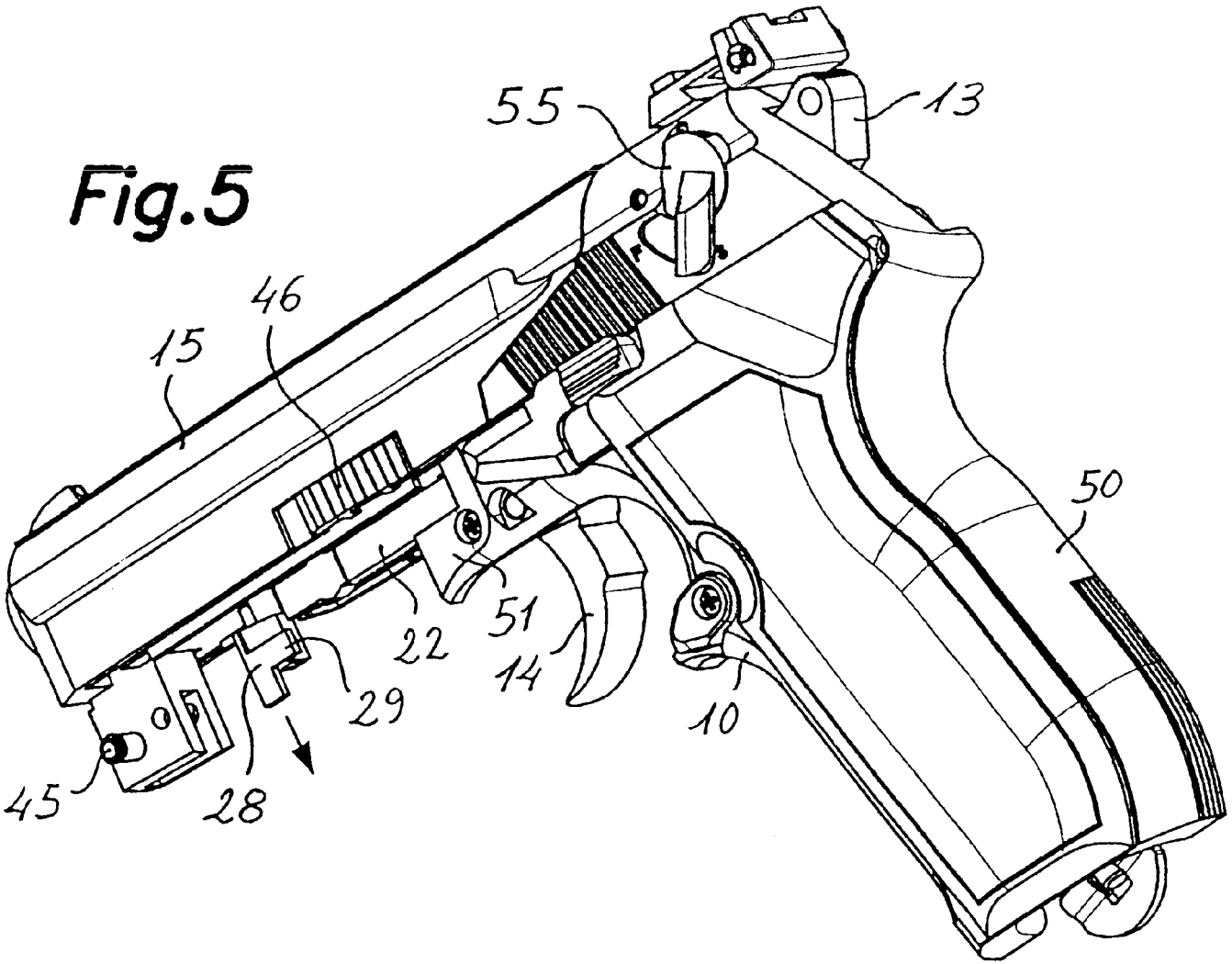
FIGS. 5 and 6 are three quarters rear lower views in perspective of the gun of FIG. 1 with the tilting assembly in closed firing position, and in the open loading position, respectively, showing some parts sectioned or withdrawn for best showing the operation of the safety device for locking the trigger at the open loading position.
Figure 6:
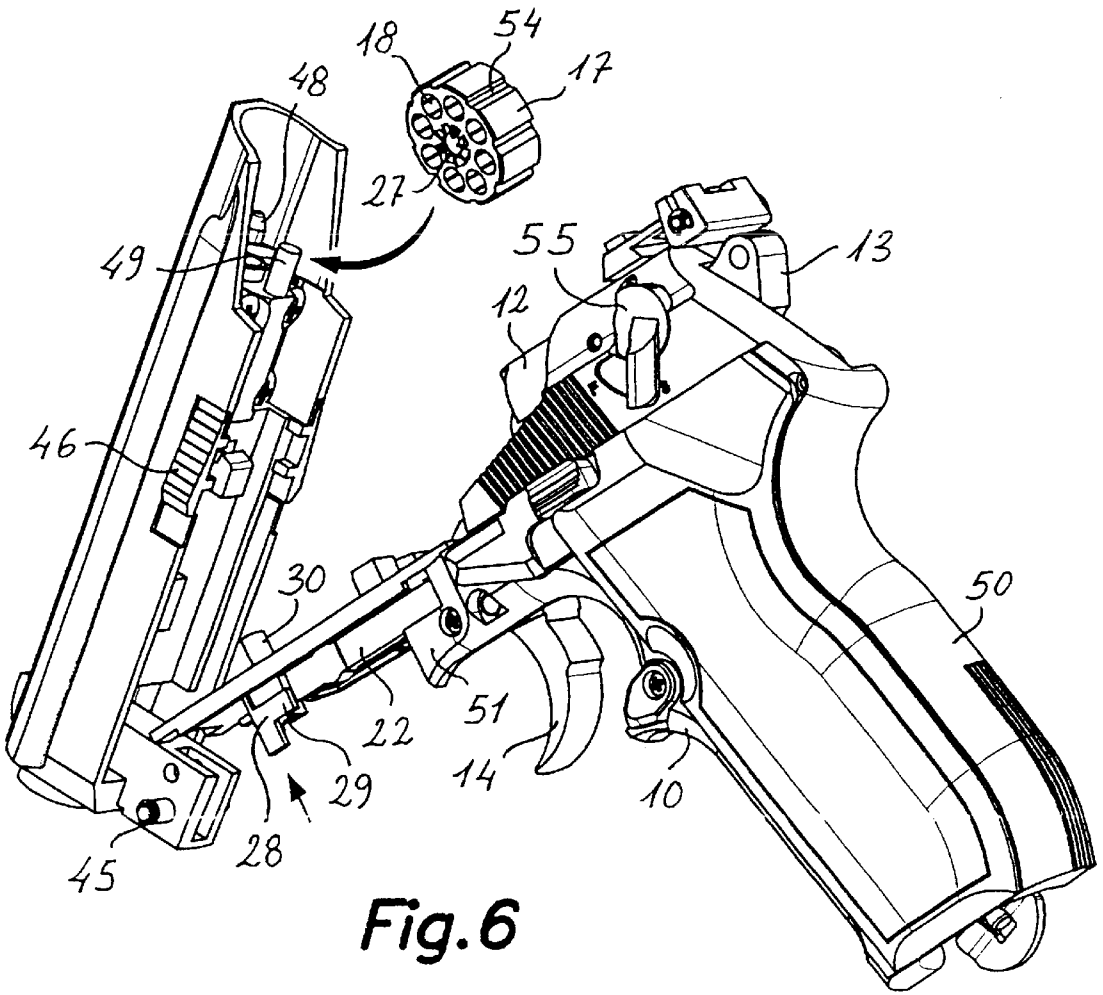

On the part of the barrel 51 of the frame 10 is mounted, hinged a tilting assembly 15 provided with a movement between an open loading position shown in FIG. 6 and a closed firing position shown in FIG. 5. The tilting assembly 15 comprises a barrel 16 and a detachable cylindric loading clip 17 rotatably mounted with respect to an axis 49 parallel to the longitudinal axis of the barrel 16, the loading clip 17 being provided with a plurality of recesses 18 holding a projectile (see FIGS. 3, 4 and 6) and ratchet teeth 27 annularly arranged on a front face thereof. The tilting assembly 15 rotates about an axis 45 transversal to the longitudinal axis of the barrel located at the end of the frame 10 distal from the valve assembly 12, these means being provided with latch means 46 (FIGS. 5 and 6) for keeping the tilting assembly 15 at its firing position or allowing its opening.

FIG. 6 shows a pivot 49 located at the free end of the tilting assembly on which the loading clip 17 is placed and rotates. At a given distance from the pivot 49 there is an elastically loaded stub 48, which is successively coupled to each of a plurality of notches 54 axially arranged on an external cylindric wall of the loading clip 17, guaranteeing with it the accurateness of the alignment of each recess 18 of the loading clip 17 with the barrel mouth 16 at the moment of firing.

On one part of the frame 10 comprised between the rotating axis 45 of the tilting assembly 15 and the valve assembly 12 are mounted step by step rotating means associated to the movement of the trigger 14 to step by step rotate loading clip 17 in order to align one of the recesses 18 holding a projectile with the barrel 16. The step by step rotating means comprise a first set of levers, functionally connected to each other, one of the levers being linked to the trigger 14, another of the levers being linked to the loading clip 17 when the tilting assembly 15 is at the firing position.

Figure 3:
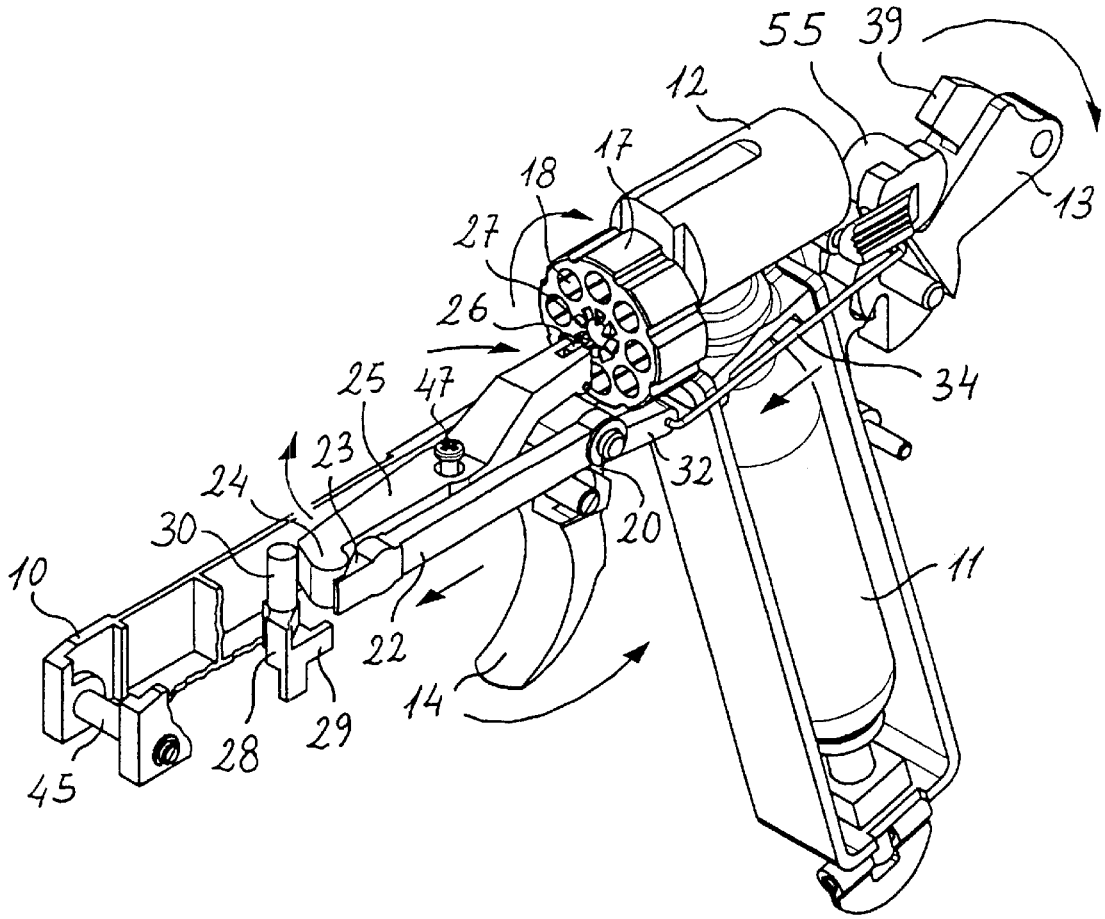
FIG. 3 is a three quarters front top view in perspective of the gun of FIG. 1 from which some parts have been withdrawn or partly sectioned for best showing the step by step rotating mechanisms, locking safety of the trigger at the loading open position and safety against falls.

FIGS. 3 and 4 clearly show the first set of levers, which comprises a trigger lever 20 integral with the trigger 14, the trigger lever 20 moving a slide 22 linearly guided on the frame 10 in a direction parallel to the direction of the barrel in firing position, and which has shaped at one end distal of the trigger, an inclined plane 23 which cooperates with a cam 24 located at a first end of a lever 25 hinged by its middle area with respect to the frame 10 through an axis 47 transversal to the direction of the barrel in firing position and perpendicular to the hinge pin 45 of the tilting assembly 15. At a second end of the lever 25, opposite to the first end, there is provided a driving finger 26, elastically loaded, which may be coupled to the teeth 27 annularly arranged on the front face of the loading clip 17 when the tilting assembly 15 is in firing position, so that when passing the trigger 14 from its resting position to its firing position, the trigger bar 20 pushes the slide 22 moving it forwards with which the inclined plane 23 displaces the cam 24 making the lever 25 tilts and provoking a displacement of the driving finger 26 which is coupled with one of the teeth 27 making the loading clip 17 rotates for locating the following recess 18 holding a projectile at a position aligned with the barrel 16.

The gun of this invention in addition includes locking means for locking the movement of the trigger 14 by immobilizing a member of the first set of levers when the tilting assembly 15 is at mentioned open loading position in which there is an access to the loading clip 17, the locking means are released by the action of the tilting assembly 15 when the tilting assembly 15 is located at its closed firing position, in which the barrel 16 and a related recess 18 holding a projectile of the loading clip 17 remain aligned with an outlet of the assembly of compressed air delivery valve 12.

The locking means comprise a locking part 28 slidingly mounted on the frame 10 on a direction substantially perpendicular to the hinge pin 45 of the tilting assembly 15, the locking part 28 is elastically loaded and comprises a stop configuration 29, and a top protrusion 30 which can be coupled to a lower area of the tilting assembly 15. Thus, when the tilting assembly 15 is at its loading position (see FIG. 6), the top protrusion 30 is free of contact with it, therefore the elastic load keeps the locking part 28 at a lifted position so that the stop configuration 29 remains facing the end of the said slide 22, preventing the displacement thereof and with it the action of the trigger 14. On the contrary, when the tilting assembly 15 is in its firing position, as it is shown in FIGS. 1 to 4, and specially in FIG. 5, the top protrusion 30 is pushed by the tilting assembly 15, which downwardly moves the locking part 28 withdrawing the stop 29 from the front of the slide 22 end, allowing to displace this latter and with it the action of the trigger 14.

The gun according to the invention also comprises safety means for preventing that the hammer 13 strikes the valve slide 31 without the trigger 14 has been operated the safety means comprise a safety part 19 functionally connected to the trigger 14 through a second set of levers, the safety part 19 remaining in a position interposed between the valve slide 31 and the hammer 13, transmitting the strength of the impact thereof when the trigger 14 is in its firing position the safety part 19 remains withdrawn from the intermediate position when the trigger 14 is in its resting position, so that an eventual impact of the hammer 14 does not reach the valve slide 31.

FIG. 4 clearly shows the second set of levers for operating the fall safety device, which comprises a trigger bar 20 integral with the trigger 14, the trigger bar 20 moving an arm 32 connected through a tie bar 34 with a rocker 33 tiltably mounted on the frame 10 in a position at the rear and under the valve slide 31 and under the path of a head 39 of the hammer 13. The rocker 33 tilts according to an axis 44 transversal to the longitudinal axis of the barrel, by the effect of the displacement of the tie bar 34. On the rocker 33 there is hingedly mounted the safety part 19 so that it moves in a direction substantially transversal to the axis of the barrel in the firing position by virtue of the tilting movement of the rocker 33.

The safety part 19 has a circular cross section and is C-shaped, comprising an hinging portion 35 mounted so that it can rotate within a hole 36 of the rocker 33, a linking portion 37 and a head portion 38 which is placed in or withdrawn from the position interposed between the valve slide 31 and the hammer 13 when the trigger 14 is in its firing or resting position, respectively. The circular section of the head portion secures the perpendicular transmission of the strength of the hammer 13 impact to the valve slide 31.

The gun of this invention comprises, in addition to the safety devices disclosed, a shot safety having a conventional operation, which is operated by means of a lever 55 (FIGS. 3, 5 and 6) which has, as usual, a first position in which any firing possibility is locked and a second position in which firing is allowed.

What is claimed is:

1. Air or gas-powered gun comprising a frame bearing a compressed air or gas reservoir connected to an air or gas delivery valve assembly operated by a hammer striking a valve slide, a trigger mounted on the frame so as to move between a resting position and a firing position, the trigger being able to operate the hammer, a tilting assembly hingedly mounted on the frame so as to move between an open loading position and a closed firing position, the tilting assembly comprising a barrel and a detachable cylindric loading clip rotatably mounted with respect to an axis extending parallel to the longitudinal axis of the barrel, the loading clip being provided with a plurality of recesses holding a projectile, step by step rotating means associated to the movement of said trigger to step by step rotate the loading clip for aligning one of the plurality of recesses holding a projectile with the barrel, the step by step rotating means being mounted on a part of the frame with respect to which the tilting assembly bearing the barrel and the loading clip is hinged, the step by step by step rotating means comprising a first set of levers functionally connected to each other, one of the first set of levers being linked to the trigger, another of the levers being linked to the loading clip when the tilting assembly is in the firing position; and a locking safety device for locking the movement of the trigger by immobilizing a member of the first set of levers when the tilting assembly is in the open loading position in which an access to the loading clip is provided.

2. Gun according to claim 1, wherein the locking safety device is released by action of the tilting assembly when the tilting assembly is located in the closed firing position, in which the barrel and a corresponding recess holding a projectile of the loading clip remains aligned with an outlet of the compressed air delivery valve assembly.

3. Gun, according to claim 1, further comprising safety means for preventing the hammer striking the valve slide without operating the trigger, the safety means comprising a safety part functionally connected to the trigger through a second set of levers, the safety part remaining at a position interposed between the valve slide and the hammer, transmitting the impact strength thereof, when the trigger is in the firing position, and the safety part remains withdrawn from an intermediate position when the trigger is in the resting position, so that an eventual impact of the hammer does not reach the valve slide.

4. Gun according to claim 2, wherein the first set of levers comprises a trigger bar integral with the trigger, the trigger bar displacing a slide linearly guided on the frame in a direction parallel to the direction of the barrel in the firing position, and which has shaped at a distal end of the trigger, an inclined plane cooperating with a cam located at a first end of a lever hinged at a middle area with respect to the frame through an axis extending transversal to the direction of the barrel at the firing position, and at a second end opposite to the first end of the lever an elastically loaded driving finger is coupled with annularly arranged teeth on a front face of the loading clip when the tilting assembly is in the firing position, so that when the trigger passes from the resting position to the firing position, the trigger bar pushes the slide moving the slide forwards so that the inclined plane moves the cam making the lever tilted and the driving finger is coupled with one of the teeth rotating the loading clip for locating a following recess holding a projectile at a position aligned with the barrel.

5. Gun according to claim 4, wherein the locking safety device for locking the movement of the trigger when the tilting assembly is at the open loading position comprises a locking part slidingly mounted on the frame in a direction substantially perpendicular to a hinge pin of the tilting assembly, the locking part being elastically loaded and comprising a stop configuration facing an end of the slide and preventing displacement of the slide, when the tilting assembly is in the open loading position and a top protrusion is pushed by the tilting assembly when the tilting assembly is in the closed firing position, downwardly displacing the locking part withdrawing the stop configuration from a front of the slide end allowing displacement and action of the trigger.

6. Gun according to claim 3, wherein the second set of levers comprises a trigger bar integral with the trigger, the trigger bar displacing an arm connected through a tie bar with a rocker tiltably mounted on the frame in a position at a rear and under the valve slide and under the a path of a head of the hammer, the rocker tilting by displacement of the tie bar and on the rocker is hingedly mounted the safety part so that the safety part moves in a direction substantially transversal to the axis of the barrel in the firing position by virtue of a tilting movement of the rocker.

7. Gun according to claim 6, wherein the safety part has a circular cross section and is C-shaped, comprising a hinging portion mounted so that the hinging position rotates within a hole of the rocker, a linking portion and a head portion is placed in or withdrawn from the position interposed between the valve slide and the hammer when the trigger is in the firing or resting position, respectively.

8. Gun, according to claim 1, wherein an elastically loaded stub is located at a free end of the tilting assembly, separated in parallel at a given distance from a rotating axis of the loading clip, the stub is subsequently coupled in each of a plurality of notches axially arranged on an external cylindric wall of the loading clip, guaranteeing an accurate alignment of each of the recesses of the loading clip with a mouthpiece of the barrel.

* * * * *